US008356922B2

(12) United States Patent
Gallai et al.

(10) Patent No.: US 8,356,922 B2
(45) Date of Patent: Jan. 22, 2013

(54) REFLECTOR LAMP USED AS DAYTIME RUNNING LAMP

(75) Inventors: Jozsef Gallai, Budapest (HU); Zoltan Bako, Dunakeszi (HU); Imre Molnar, Budapest (HU)

(73) Assignee: General Electric Company, Schenectady, NY (US)

( * ) Notice: Subject to any disclaimer, the term of this patent is extended or adjusted under 35 U.S.C. 154(b) by 52 days.

(21) Appl. No.: 12/983,657

(22) Filed: Jan. 3, 2011

(65) Prior Publication Data

US 2012/0170297 A1 Jul. 5, 2012

(51) Int. Cl.
*F21V 7/04* (2006.01)

(52) U.S. Cl. ..... 362/549; 362/310

(58) Field of Classification Search ..... 362/186, 362/310, 362, 365, 368, 370–372, 374, 375, 362/382, 418, 419, 439, 549, 261, 507, 538, 362/548

See application file for complete search history.

(56) References Cited

U.S. PATENT DOCUMENTS

| | | | | | |
|---|---|---|---|---|---|
| 1,358,543 | A * | 11/1920 | Hardon | 16/26 |
| 2,266,329 | A * | 12/1941 | Mead et al. | 362/549 |
| 2,824,215 | A * | 2/1958 | Goff | 362/428 |
| 2,826,682 | A * | 3/1958 | Falge | 362/273 |
| 3,050,621 | A * | 8/1962 | Spencer | 362/382 |
| 3,493,740 | A * | 2/1970 | Onksen | 362/365 |
| 3,621,230 | A * | 11/1971 | Dwight | 362/428 |
| 3,670,158 | A * | 6/1972 | Suzuki et al. | 362/273 |
| 3,676,666 | A * | 7/1972 | White | 362/374 |
| 3,823,314 | A * | 7/1974 | Germany | 362/419 |
| 3,836,763 | A * | 9/1974 | Hoffman et al. | 362/374 |
| 7,553,052 | B2 * | 6/2009 | Suzuki | 362/374 |
| 7,883,245 | B2 * | 2/2011 | Melzner | 362/370 |
| 2006/0171155 | A1 | 8/2006 | Hain | |

* cited by examiner

*Primary Examiner* — Hargobind S Sawhney
(74) *Attorney, Agent, or Firm* — Fay Sharpe LLP

(57) ABSTRACT

An automotive daytime running lamp assembly includes an incandescent light source received within a reflector member. The reflector member is formed as a surface of revolution about a longitudinal axis and has an enlarged, first end, and a narrowed, second end with an opening that receives at least a portion of a light source therethrough along the longitudinal axis. A sleeve is received over a portion of the light source and at least partially extends through the reflector member opening. A cap received over the second end of the reflector member about the opening is fixedly secured to a disk, preferably by fusing or welding the components together. Likewise, the disk and metal sleeve are fixedly secured or fused/welded together so that the light source is fixed relative to the reflector member. A mounting member is provided for secure optical positioning of the assembly in a fixture of the associated automotive vehicle.

14 Claims, 1 Drawing Sheet

REFLECTOR LAMP USED AS DAYTIME RUNNING LAMP

BACKGROUND OF THE DISCLOSURE

This disclosure relates to a low voltage, low wattage lamp, and more particularly to an incandescent lamp that can be used as a daytime running lamp (DRL) for an automotive vehicle application.

More recent regulations directed to forward lighting for automotive vehicles promote the use of what is generally referred to as a daytime running lamp. Such daytime running lamps are intended to increase the chance that a vehicle is more noticeable and will be readily detected in daylight. The daytime running lamp is intended to face in a forward direction and is not primarily designed for illumination of the roadway ahead and to the side of the vehicle, but rather is to increase the noticeability of the vehicle and detection by other vehicles on the road. Such daytime running lamps must be generally durable and able to withstand vibrations associated with automotive use. The intensity of the light emitted by such a daytime running lamp is by regulation not less than 400 candelas in a forward axial direction and no more than 1200 candelas in any direction. Regulations also propose that the illuminating surface is not less than 25 centimeters squared ($cm^2$), that the lamp shall emit a white light, and that the lamp is operable at voltages ranging from 6-24 volts. Photometric performance of the vehicle is also regulated, and it is also recognized that the lamp may be a non-replaceable light source.

A need exists for a lamp that has a built-in reflector, thus defining a module that can provide the desired DRL intensity distribution (i.e., fully compliant with relevant ECE Regulation No. 87). Preferably, the filament lamp is not changeable, and the lamp and reflector together would preferably form a system that can be used and incorporated into headlamps of a vehicle in a replaceable form. The desire is that no additional optical elements would be needed.

SUMMARY OF THE DISCLOSURE

An automotive daytime running lamp assembly and method of manufacturing same is disclosed.

The lamp assembly preferably includes an incandescent light source in which a reflector member is formed as a surface of revolution about a longitudinal axis having an enlarged, first end and a narrowed, second end that forms an opening that receives the light source along the longitudinal axis of the reflector surface. A sleeve is received over a portion of the light source that extends through the reflector member opening at the second end. A cap secured to the second end of the reflector member is fixedly secured to the sleeve so that the light source is fixed relative to the reflector member.

In a preferred arrangement, a disk is received over the sleeve and fixedly connected to each of the cap and the sleeve.

Preferably, the disk is fused or welded to the cap, and likewise fused or welded to the sleeve. This allows the lamp to be moved relative to the reflector member, then securely fixed in the x-y direction, and subsequently welded into a desired, stable position that fixes the light source relative to the reflector member.

Preferably, the light source has a wattage that ranges from approximately 10 watts to about 35 watts.

The enlarged, first end of the reflector member may be closed by a lens if so desired, although in the preferred arrangement the first end of the reflector does not include a lens or cover and therefore is open.

The method of manufacturing the automotive DRL assembly includes providing an incandescent light source, positioning the reflector member around the light source with a portion of the light source extending through a narrowed, second end opening. The sleeve extends over a portion of the light source, and a cap is secured to the second end about the opening, and also the cap is fixedly secured to the sleeve to fix the light source relative to the reflector member.

The method further includes providing a disk over the sleeve that is fixedly connected to both the cap and the sleeve.

In a preferred arrangement, the disk is fused or welded to each of the cap and the sleeve.

A primary benefit of the present disclosure is the provision of a reflector module having regulation compliant light distribution built into a headlamp.

Still another benefit is the ability to adjust the location of the light source relative to the reflector surface and then fix this location in an easy manner.

Yet another benefit resides in the decrease in overall system costs since there is no requirement for a further optical system design.

Still other benefits and advantages of this disclosure will become more apparent upon reading and understanding the following detailed description.

DETAILED DESCRIPTION OF THE PREFERRED EMBODIMENTS

Figure 2:
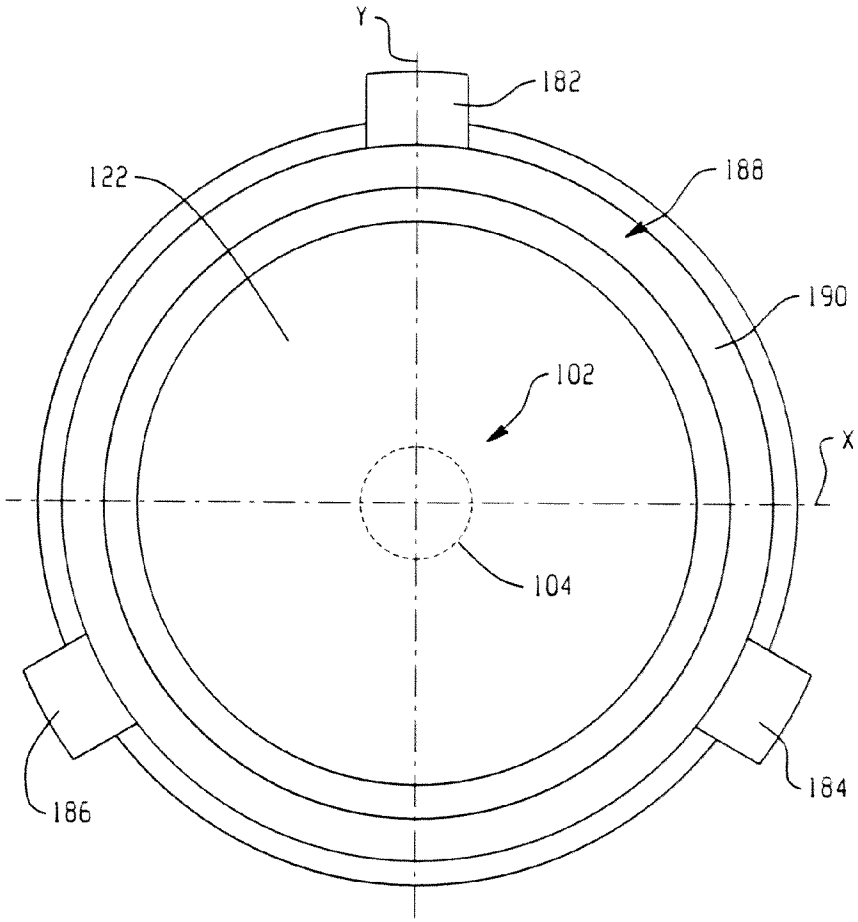
FIG. 2 is a plan view taken generally from the left-hand side of FIG. 1.
Figure 1:
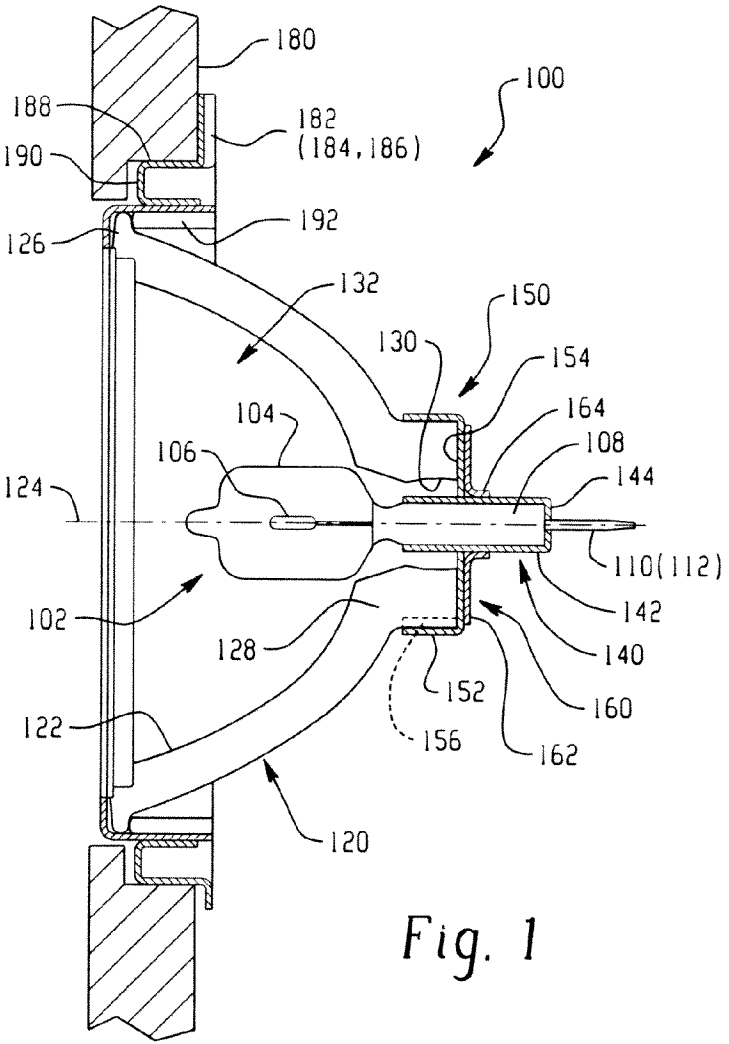
FIG. 1 is a longitudinal cross-sectional view through the automotive lamp assembly, particularly a reflector lamp used as a daytime running lamp.

Turning to FIGS. 1 and 2, there is shown an automotive lamp assembly, and particularly an automotive daytime running lamp assembly 100 that includes an incandescent light source 102. The light source 102 has a sealed envelope 104 that encloses a filament 106. A pinch or sealed end 108 has a generally planar conformation that seals first and second leads 110, 112 extending through the pinch end from electrical and mechanical connection to opposite ends of the filament. Likewise, the first and second leads are electrically and mechanically connected to an external power source (not shown).

Surrounding the light source is a reflector member 120. The reflector member is preferably a surface of revolution 122 formed about a longitudinal axis 124. The longitudinal axis of the reflector member coincides, is coaxial, or coincident with the longitudinal axis of the light source. Further, the surface of revolution includes an enlarged, first end 126 and a narrowed, second end 128 that has an opening 130. The opening 130 is slightly larger than the pinch end 108 of the light source so that the light source can be moved or adjusted relative to the reflector member in the x- and y-directions (FIG. 2) and ideally position the filament relative to the focus of the reflector surface. That is, that portion of the envelope 104 surrounding the filament has a dimension greater than that of the opening 130 in the reflector member and thus the light source is introduced into an interior or cavity 132 of the reflector member through the enlarged, first end 126 of the reflector member body. The pinch end 108 of the light source extends at least partially outward through the opening and has a portion that extends axially outward from the reflector member.

In the arrangement shown in FIG. 1, the first end 126 of the reflector member terminates along the longitudinal axis a dimension greater than that of the light source envelope (in a direction to the left as shown in FIG. 1) so that the envelope portion of the light source is contained in the reflector member cavity 132 and only a portion of the pinch end of the light source extends from the reflector member. In the illustrated embodiment, the reflector surface 122 is shown as a generally simple surface of revolution such as a parabolic surface, although one skilled in the art will appreciate that other surface shapes can be used or still other more complex or compound surfaces may be included as alternative reflector surfaces. In the illustrated embodiment, the location of the light source (and particularly the location of the filament of the light source) can be adjusted relative to the reflector member in order to maximize light output and precision location of the light source relative to the reflector surface and thereby provide the desired forward light output from the daytime running lamp assembly. A sleeve, such as a metal sleeve 140, is received over at least a major portion of the pinch end 108 of the light source. Preferably, the metal sleeve has a first, axial portion 142 and a second, radial portion 144 that is turned radially inward at one end of the sleeve to provide a precise fit over the pinch end of the light source. The radial portion 144 is dimensioned to permit the leads 110, 112 to extend outwardly from the light source. The axial portion 142 of the metal sleeve 140 has a dimension that extends over a major length of the pinch end so that axial adjustment of the light source along the longitudinal axis 124 still assures that some portion of the metal sleeve is present for fixing purposes as will be described further below.

In addition, a cap, such as metal cap 150, is received over the second end 128 of the reflector member. Like the metal sleeve, the cap 150 includes an axial, first portion 152 and a radial, second portion 154 that extends generally radially inward from one end of the axial portion 152 of the metal cap 150. Intrusions or recesses in the glass reflector member cooperate with radially inward projections or extensions 156 in the cap that are received in and click into the intrusions to fix the cap to the reflector. This assures that the cap 150 is properly positioned over the second end 128 of the housing and accurately fixed thereto. That is, the radially extending portion 154 abuts against the axial end of the second end 128 of the reflector member. In addition, the radial portion 154 extends radially inward a dimension such that the inner radial edge is closely adjacent to the metal sleeve 140 received over the pinch end of the light source, but sufficiently dimensioned or spaced therefrom to allow adjustment of the light source relative to the reflector member along the x- and y-axes as illustrated in FIG. 2.

A holding member or disk 160 has an annular, first portion or planar region 162 that lies flush against and abuts the radially extending end 154 of the cap. Longitudinal or axially extending second portion 164 of the disk is generally perpendicular to the planar region 162, and extends substantially parallel to the axial portion 142 of the metal sleeve 140.

The metal sleeve 140 is initially connected to the light source, and particularly received over the pinch end 108 such that the radial portion 144 abuts against the terminal end of the light source pinch. Similarly, cap 150 is positioned over the narrow, second end 128 of the reflector member. Intrusions in the glass reflector member and extensions in the cap that click into the intrusions provide for fixing the cap to the reflector. Upon introduction of the pinch end 108 of the light source from the enlarged first end 126 of the reflector member and through the opening 130 of the reflector member at the narrowed, second end 128, and likewise through an opening formed by the inner terminal edge of the radial portion 154 of the metal cap, the disk 160 is then slid over the metal sleeve and pinch end until the planar surface 162 abuts against the outer surface of the radial portion 154 of the cap.

Suitable adjustments are made in the x- and y-directions, and then the disk 160 is securely fixed relative to the cap 150 and also relative to the sleeve 140 thereby fixing the position of the light source relative to the reflector member. Fixedly securing the cap 150 to both the sleeve 140 and the disk 160 is preferably by way of fusing the component pairs together, that is welding the disk 160 to the cap 150 and also welding the disk 160 to the sleeve 140. In the preferred arrangement, the cap and disk are fused or welded along the abutting surfaces 154, 162, while the disk and metal sleeve are fused or welded along axial extending portion 164 of the disk and the axial portion 142 of the metal sleeve 140. Once these individual components are welded together, the light source 102 is maintained in fixed relation relative to the reflecting surface 122 and is able to withstand the vibration associated with the automotive environment.

Preferably, the enlarged, first end 126 of the reflective member can remain open in order to extend the life of the light source since heat can escape from the cavity 132 and not contribute to early failure of the light source. In addition, alignment of the lamp assembly relative to a reference plane 180 of the associated automotive vehicle is provided. More particularly, at least three locations or points are defined by positioning lugs 182, 184, 186 (FIG. 2) that define the optical plane and abut against the surface 180 and advantageously hold the lamp module in the correct angular (rotational alignment) position. Mounting member, disc, or flange 188 is attached to the enlarged first end of the reflector, preferably by welding or fusing together with additional ring 192 that fixes the disc or flange to the reflector, holding the reflector member in a circumferential direction along the rim. The disc or flange 188 includes a shoulder 190, with three radial extensions 182, 184, 186 that abut against the reference plane 180 to define the optical plane and hold the lamp module in the associated fixture of the automotive vehicle in the correct angular position. As a result, the reflective surface 122 is accurately oriented or aligned relative to the associated automotive vehicle, and because the light source 102 was securely mounted within the reflector member 120, the output efficiency of the light source is maximized. In this manner, all adjustments are completed relative to the reference plane and light distribution is optimized.

The incandescent filament light source 102 may range from approximately 10 watts up to approximately 35 watts. The reflector surface 122 preferably has an aluminum coating or other highly reflective surface that is designed to provide the desired half-width angle and peak candela requirements of the daytime running lamp regulations. The reflector module with the lamp or light source 102 joined as described above provides for a regulation compliant light distribution that requires no additional optical elements. It is not intended that the light source be changeable in this system, rather the lamp and reflector together would form a system that would be removed or replaced as needed.

The disclosure has been described with reference to the preferred embodiments. Obviously, modifications and alterations will occur to others upon reading and understanding the preceding detailed description. It is intended that the invention be construed as including all such modifications and alterations.

What is claimed is:

1. An automotive lamp assembly comprising:

an incandescent light source;

a reflector member formed as a surface of revolution about a longitudinal axis having an enlarged, first end and a narrowed, second end having an opening that receives the light source along the longitudinal axis at a focal point of the reflector surface;

a cap having an axial portion and a radial portion both abutting respective portions of the reflector member and secured to the reflector member second end about the opening;

a sleeve having an axial portion received over a seal portion of the light source extending through the reflector member opening and a radial portion extending over an end of the light source fixedly secured to the cap whereby the light source is fixed relative to the reflector member; a disc received over and fixedly secured to the sleeve, and the disk fixedly connected to the cap; and;

a mounting member attached to the enlarged, first end of the reflector with at least three positioning lugs defining a reference surface for alignment of the assembly.

2. The lamp assembly of claim 1 wherein the at least three positioning lugs rotationally align the reflector.

3. The lamp assembly of claim 1 wherein the incandescent light source has a wattage ranging from approximately 10 W to 35 W.

4. A method of manufacturing an automotive lamp assembly comprising:

providing an incandescent light source;

positioning a reflector member formed as a surface of revolution about a longitudinal axis having an enlarged, first end and a narrowed, second end having an opening around the light source along the longitudinal axis at a focal point of the reflector surface;

securing a cap to the second end about the opening;

locating a sleeve over a portion of the light source extending through the reflector member opening;

fixedly securing the cap to the sleeve whereby the light source is fixed relative to the reflector member.

a mounting member attached to the enlarged, first end of reflector with at least three positioning lugs defining a reference surface for the rotational alignment of the assembly.

5. The method of claim 4 further comprising providing a disk over the sleeve.

6. The method of claim 5 wherein the fixedly securing step includes fusing the disk to the cap.

7. The method of claim 5 wherein the providing step includes fusing the disk to the sleeve.

8. The method of claim 7 wherein the fixedly securing step includes fusing the disk to the cap.

9. The method of claim 4 wherein the mounting member rotationally aligns the lamp assembly relative to the associated automotive vehicle.

10. The method of claim 4 further comprising positioning a disk over the sleeve and fixedly connecting the disk to the cap.

11. The method of claim 10 wherein the fixedly connecting step including fusing the disk to the sleeve.

12. An automotive daytime running lamp assembly comprising:

an incandescent light source;

a reflector member formed as a surface of revolution about a longitudinal axis having an enlarged, first end and a narrowed, second end having an opening that receives the light source along the longitudinal axis at a focal point of the reflector surface;

a sleeve received over a portion of the light source extending through the reflector member opening;

a cap received over the second end about the opening;

a disk received over and fixedly secured to the sleeve and fixedly secured to the cap whereby the light source is fixed relative to the reflector member; and a mounting member attached to the enlarged, first end of the reflector with at least three positioning lugs for aligning the lamp assembly relative to an associated automotive vehicle.

13. The lamp assembly of claim 12 wherein the incandescent light source has a wattage ranging from approximately 10 W to 35 W.

14. The lamp assembly of claim 12 further comprising a lens received over the enlarged, first end of the reflector member.

* * * * *